United States Patent [19]

Proctor et al.

[11] Patent Number: 4,840,229

[45] Date of Patent: Jun. 20, 1989

[54] MULTIPLE POSITION SERVICE SEAL UNIT WITH POSITIVE POSITION INDICATING MEANS

[75] Inventors: Lewis D. Proctor, Kincardineshire, Scotland; Colby M. Ross, Carrollton, Tex.; Brian P. Manzi, Montrose, Scotland; Frank Giusti, Jr., Lewisville, Tex.

[73] Assignee: Otis Engineering Corporation, Carrollton, Tex.

[21] Appl. No.: 98,410

[22] Filed: Sep. 18, 1987

Related U.S. Application Data

[62] Division of Ser. No. 846,290, Mar. 31, 1986, Pat. No. 4,722,392.

[51] Int. Cl.[4] ..... E21B 23/00

[52] U.S. Cl. ..... 166/381; 166/217; 166/237; 166/382

[58] Field of Search ..... 166/237, 217, 381, 206, 166/115, 51, 242, 113, 73, 382, 125, 355, 255

[56] References Cited

U.S. PATENT DOCUMENTS

| | | | |
|---|---|---|---|
| Re. 30,070 | 8/1979 | Sizer et al. | 166/217 X |
| 3,032,113 | 5/1962 | Dollison | 166/237 X |
| 3,556,220 | 1/1971 | Schwegman | 166/120 X |
| 3,856,081 | 12/1974 | Canalizo | 166/217 X |
| 3,888,306 | 6/1975 | Wetzel | 166/255 |
| 4,319,638 | 3/1982 | Baker et al. | 166/355 |
| 4,364,430 | 12/1982 | Szarka | 166/381 X |
| 4,369,840 | 1/1983 | Szarka et al. | 166/214 |

*Primary Examiner*—Hoang C. Dang

*Attorney, Agent, or Firm*—Dennis T. Griggs

[57] ABSTRACT

A production sub carrying a plurality of annular locator rings is coupled in series relation with downhole production equipment. A collet latch assembly including fixed and floating collet members is connected to a down hole service tool and is inserted into releasable coupling engagement with the annular locator rings of the production sub. Resilient finger portions of the fixed collet are alternately supported and unsupported by the floating collet to establish positive engagement with a selected one of the annular locator rings or to permit passage of the latch assembly with respect to the locator ring. The foregoing arrangement provides positive restriction to longitudinal movement of a work string which allows a downhole service tool attached to the work string to be selectively positioned at predetermined operating locations relative to downhole equipment. Additionally, the positioning assembly provides partial restriction to longitudinal movement of a work string for activating the motion-compensating equipment of a floating service vessel so that ocean heave or swell does not cause excessive longitudinal excursions of a downhole service tool attached to a service string which is supported by the floating vessel.

4 Claims, 5 Drawing Sheets

MULTIPLE POSITION SERVICE SEAL UNIT WITH POSITIVE POSITION INDICATING MEANS

CROSS REFERENCE TO RELATED APPLICATION

This is a division of application Ser. No. 846,290 filed Mar. 31, 1986 now the U.S. Pat. No. 4,722, 392.

FIELD OF THE INVENTION

This invention relates to tools and equipment for servicing downhole wells.

BACKGROUND OF THE INVENTION

In the course of performing various downhole well servicing operations, it is necessary to raise and lower a service tool within the well to set, position or release downhole equipment. The sucess of such operations is dependent upon the ability to reciprocate the tool a predetermined distance relative to the downhole equipment, and moreover, to reliably detect not only the fact of a desired displacement, but also that the displacement has occurred relative to a specific item of downhole equipment.

For example, such a requirement is essential for the successful installation of a gravel pack. In one class of such equipment, a service seal unit carried by a work string is reciprocated relative to certain flow ports and sealing points within a packer bore to route fluid along various passages. The service seal unit carries vertical and lateral circualtion passages which, when aligned with ports formed in a packing unit, permits service fluids such as acids, polymers, cements, sand or gravel-laden liquids to be injected into a formation through the bore of the work string and into the outer annulus between the sand screen and the perforated well casing, thereby avoiding plugging or otherwise damaging the sand screen.

In another position of the service seal unit, the annulus below the packer is sealed and the lateral flow passages of the service seal unit are positioned for discharge directly into the annulus between the work string and the well casing, thereby permitting reverse flow of clean-out fluids through the annulus between the work string and the well casing and upwardly through the bore of the work string.

The position of lateral flow passages and seals carried by the service unit must be closely controlled to insure that such service operations are performed correctly.

The foregoing procedures become more difficult in performing service operations on an off-shore well. Service operations in water depths exceeding a few hundred feet are generally performed from a floating, semi-submersible platform, or from a ship, which are supported by buoyancy and not from the sea bottom. In such operations, a marine riser connects well head equipment to a surface facility to provide a stable conduit through which the production or work string is extended and production fluids are conveyed to the service vessel.

The marine riser and work string cannot withstand compression loading and therefore must be supported under tension at the water surface to prevent collapse. This is easily accomplished when the surface facility is a production platform which is fixed to the ocean floor, but a more difficult problem is presented when the water depth is so great that the surface facility must be floating and thus subjected to the effects of wave-induced heave and swell forces.

DESCRIPTION OF THE PRIOR ART

Present methods for determining the position of a suspended tool involve measurements of surface displacements of the work string and monitoring tension and hydralic pressure levels. Topside measurments of work string displacement and tension may be unreliable in deep or deviated wells because of the inherent "stretch" in the work string and because of frictional binding between the work string and well casing. Hydraulic pressure measurements may be ambiguous without specific knowledge of downhole equipment settings and/or relative positions.

Tensioner systems have been developed for off-shore production activities to compensate for wave-induced rise and fall movements of the floating service vessel. Conventional tensioner systems have commonly used hydraulic compensating cylinders connected by cables to the riser and to the traveling block which supports the work string.

The heave compensator apparatus attached to the work string is set to maintain tension in the work string and to prevent its collapse which would be expected should the work string undergo compression loading. Although the work string is suspended from the service vessel, compression loading can occur even when the service tool is not engaged with the packer because of binding engagement between the work string and the riser and/or casing. In another instance, when a packer is set and engaged against the bore of the well casing, the service seal tool may be landed in engagement with the packer bore during a formation charging operation. It is essential that tension be maintained in the work string for protection against compression loading to which it would be subjected because of the rise and fall of the floating service vessel. Thus the heave compensator apparatus for the work string is set to maintain a positive level of tension in the work string. The magnitude of the positive tension level is dependent upon the length of the work string.

While the marine riser is secured at its submerged end to well head equipment, and the position of the submerged end of the riser remains fixed, the downhole end portion of the work string is typically unsecured, according to conventional practice, during a service operation and is free to reciprocate vertically in response to heave movements of the service vessel. However, it is desired to limit movement of the service tool to maintain established alignment of flow passage or sealing surface positions during the service operation.

Although the heave and swell movements of the service vessel are decoupled somewhat with respect to the coupled position of the service tool and downhole packer because of the inherent "stretch" in the work string, the heave compensation apparatus maintains a positive tension level in the work string.

Because of the decoupling effect referred to above, a range of vessel motion can be accomodated without triggering the heave compensator. That is, the position of the lower end of the work string and the attached service tool remains essentially undisturbed within a certain range of vessel excursions. However, once that range is exceeded, the heave compensator apparatus is triggered and a sudden lifting force is applied to the upper end of the work string.

The magnitude of the lifting force applied to the work string by the heave compensator is directly proportional to the magnitude of the triggering heave force, thereby producin a correspondingly large excursion in the heave compensator draw works. On such occasions, the lower end of the work string along with the attached service tool is suddenly recriprocated violently upwardly and out of the desired zone of coupling engagement between the service tool and the packer. As a result, the service operation is interrupted and it then becomes necessary to re-establish the desired coupling engagement between the service tool and the packer and to verify that in fact the desired engagement has been achieved.

OBJECTS OF THE INVENTION

It is, therefore, an object of the invention to provide selective, positive restriction to longitudinal movement of a work string which allows a downhole service tool attached to a work string to be positioned at definite, preselected locations relative to downhole equipment.

Another object of the invention is to provide partial restriction to longitudinal movement of a work string which will activate the motion-compensating system of a floating service vessel so that ocean heave or swell does not cause excessive longitudinal excursions of a downhole service tool attached to a service string which is supported by a floating vessel.

SUMMARY OF THE INVENTION

The foregoing objects are achieved in the present invention according to a first preferred embodiment in which a locator sub carrying a plurality of locator rings is coupled in series relation with downhole production tubing. The annular locator rings are spaced apart by a distance which corresponds with specific operating locations of a downhole service tool such as a service seal unit. A collet latch assembly is connected to the work string between the downhole service tool and the tail pipe. The collet latch assembly carries a fixed annular collet and a slidable annular collet. A pair of detent locator grooves are formed in the sidewall of the collet sub and are selectively engaged by a resilient rib carried by the movable collet.

In this arrangement, the position of the fixed collet relative to the first operating position of the service tool is pre-established by the length of the collet sub and coupling sub by which it is attached to the service tool. The fixed and movable collets are resilient and deflect inwardly as the work string is lowered through the casing. The flexible finger portions of the fixed and movable collets deflect to allow passage of the compound collet assembly by each locator ring. The movable collet is engagable in a supported position within the fixed collet, thereby preventing deflection of the fixed collet as the work string is retracted. Because of the pre-established fixed spacing distance of the fixed collet relative to the service tool, the sealing services and flow passages of the service tool are positioned exactly as desired for carrying out a service operation.

When it is desired to reposition the service tool with respect to the packer to carry out another service operation, the work string is lowered through the casing which draws the head portion of the movable collet into engagement with the top side of the annular locator ring, thereby preventing its further displacement and allowing continued downward movement of the fixed collet and work string. The work string slides relative to the movable collet which is held momentarily by engagement of its head portion with the locator ring. Movement continues until the movable collet engages a stop member formed on or attached to the collet sub. In this position, the movable collet and the fixed collet are completely separated, so that the work string can then be retracted upwardly through the production tubing, with the resilient finger portions of the fixed collet deflecting inwardly to allow passage of the collet with respect to the first locator ring.

As the work string is retracted upwardly through the production tubing, the head portion of the movable collet is drawn into engagement with the next locator ring. This momentarily halts vertical displacement of the movable collet, but permits the fixed collet to be drawn into supporting engagement with the movable collet. Resilient fingers on the movable collet deflect to permit its passage through the second locator ring. Further movement of the work string is halted as the lower end of the movable collet engages the fixed collet and the fixed collet is brought into engagement with the underside of the second annular locator ring. The displacement distance of the fixed collet corresponds exactly with the displacement distance of the service tool as it moves to its second operational position.

In an alternative embodiment, partial restriction to longitudinal movement and selective positioning of a downhole service tool are provided by a positioning sub having a floating collet mounted for reciprocal movement relative to the sub. A radial shoulder formed in the sidewall of the collet sub blocks deflection of collet fingers in a supported position of the collet with the result that when the work string is retracted, the supported collet head engages the under side of an annular locator ring, thereby establishing the working position of a service tool carried by the work string.

Longitudinal displacement of the work string relative to the floating collet is limited by a pin carried by an annular collar which is mounted for rotation within the collet assembly, with the pin being received in a control slot formed in the external sidewall surface of the collet sub. The pin is constrained to travel along vertical and slanted surfaces of the control slot, with the annular collar rotating in response to movement of the pin along a slanted slot surface. By a sequence of reciprocal movements of the work string, the floating collet is moved from a first position in which the collet head is supported by the annular shoulder on the collet sub and with the collet head engaging the under side of the first locator ring, to a second position in which the collet is unsupported and is free to deflect to permit passage of the floating collet relative to the locator ring as the work string is retracted to position a service tool to a new operating position. The service tool carried by the work string is therefore accurately positioned with respect to other equipment, for example a packer, for performing various service operations.

Other objects and advantages of the present invention will be appreciated by those skilled in the art upon reading the detailed description which follows with reference to the attached drawings.

DETAILED DESCRIPTION OF THE PREFERRED EMBODIMENTS

Figure 1:
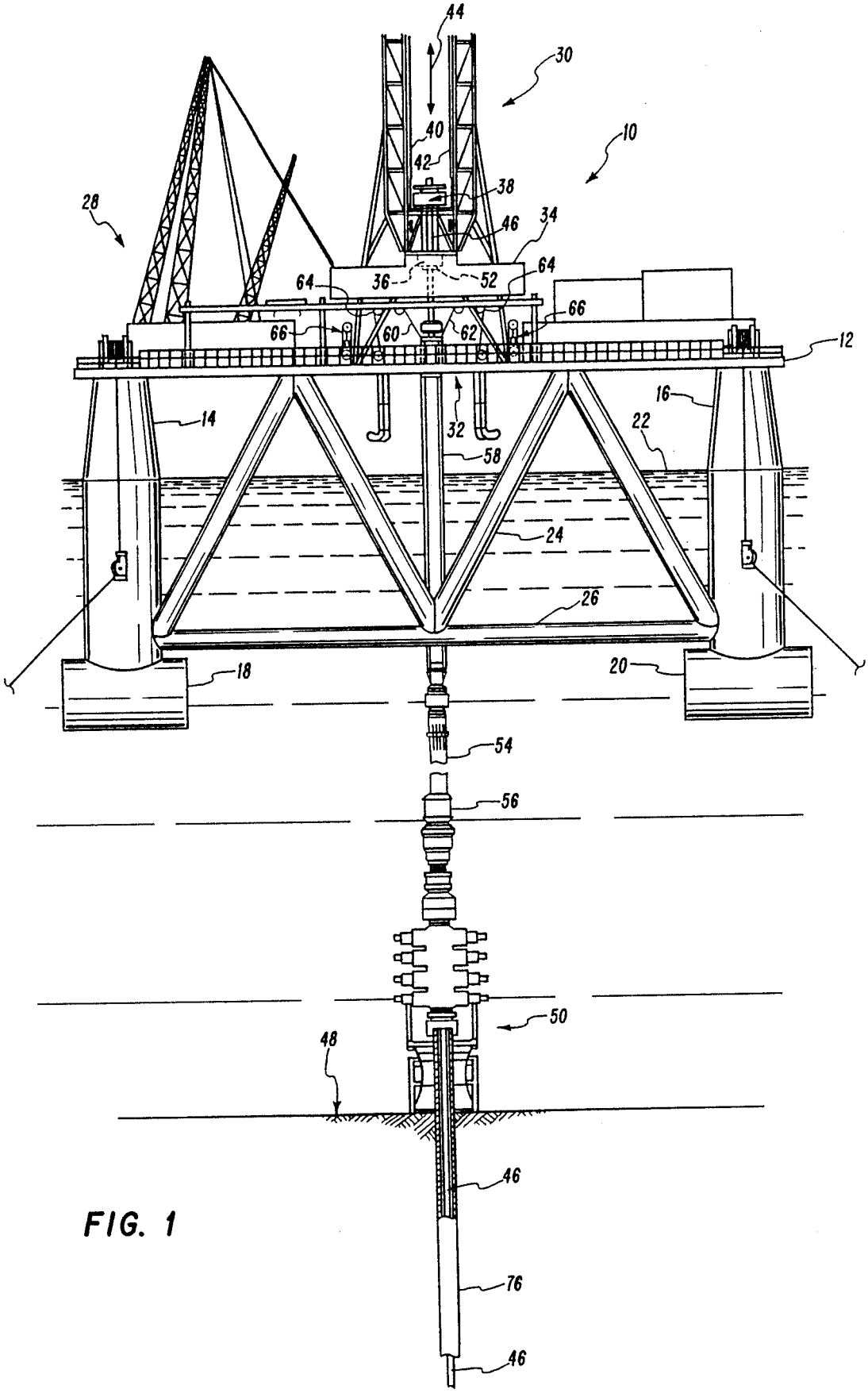
FIG. 1 is an elevational view of a semi-submersible service platform from which a marine riser and a service string are yieldably coupled by a tensioner assembly.

In the description which follows, like parts are marked throughout the specification and drawings with the same reference numerals, respectively. The drawings are not necessarily to scale and the proportion of certain parts has been exaggerated to better illustrate details of the present invention.

The reciprocating positive indicator latch assembly of the invention is illustrated and described with reference to a semi-submersible off-shore service vessel 10, the general features of which are illustrated in FIG. 1 of the drawing. The semi-submersible off-shore service vessel 10 includes a platform or main deck 12 supported by spaced stability columns 14, 16 and buoyant hulls 18, 20. The service vessel 10 is illustrated in a submerged service position in a body of water 22. Tubular trusses 24, 26 interconnect the hulls 18, 20, the stability columns 14, 16 and the deck 12. A large capacity revolving crane 28 is mounted on one side of the deck 12 for handling heavy equipment such as a BOP stack. A service derrick 30 is mounted above a moon pool opening 32 formed in a central part of the platform 12. Supported intermediate the moon pool and the derrick is a pipe handling platform 34 which includes a rotary table 36. A traveling block 38 is suspended by cables 40, 42 for reciprocal movement within the service derrick 30 as indicated by the arrow 44. The cables 40, 42 are coupled to draw works and tensioner apparatus for maintaining tension loading on a work string 46.

The semi-submersible service vessel 10 is stationed above a production site 48 in which well head equipment 50 is embedded. The well head equipment 50 includes a conventional BOP, having upper and lower stack sections in related sub-sea control equipment. The work string 46 extends from a layer of producing strata 52 (FIG. 2) through the well head equipment and to the pipe handling platform 34 where it is connected to the rotary table 36 by rotary coupling apparatus 52. The work string 46 is enclosed within a marine riser string 54. The riser string 54 is connected at its lower end to the well head equipment 50 by a ball joint assembly 56.

The upper end of the riser string 54 is coupled to the rotary table 36 by a telescopic slip joint 58 which permits vertical excursions of the vessel 10 relative to the upper end of the riser 54 in response to wave-induced heave and swell forces. The telescopic slip joint 58 is shown in its half-stroke position. The full stroke range of the telescopic joint may be as much as 45 to 55 feet. Because the riser string 54 cannot withstand compression loading, a lifting force is applied to the upper end of the riser string to maintain tension loading in the riser to prevent its collapse.

The upward lifting tension force is transmitted to the riser by a plurality of cables 60, 62 which are disposed in reeved engagement with sheaves 64 and coupled to a tensioner assembly 66. The cables 40, 42 which reciprocate the traveling block 38 are also coupled to tensioner apparatus such as the tensioner assembly 66. The tension loading applied to the work string 46 through the cables 40, 42 is preferably divided equally among a plurality of such tensioner assemblies 66. The tensioner assemblies, when activated and under equilibrium conditions, will allow relative motion between the riser and the vessel, and between the vessel and the work string.

The lower end of the marine riser 54 is secured to the well head equipment 50 by the ball joint 56. The work string 46, on the other hand, is typically unsecured during a service operation and is free to reciprocate vertically in response to heave movements of the service vessel. It will by appreciated that the tensioner compensator can, under certain conditions, apply a strong retracting force to the work string which displaces the operational position of a service tool 68 attached to the end of the work string as illustrated in FIG. 2.

Figure 2:
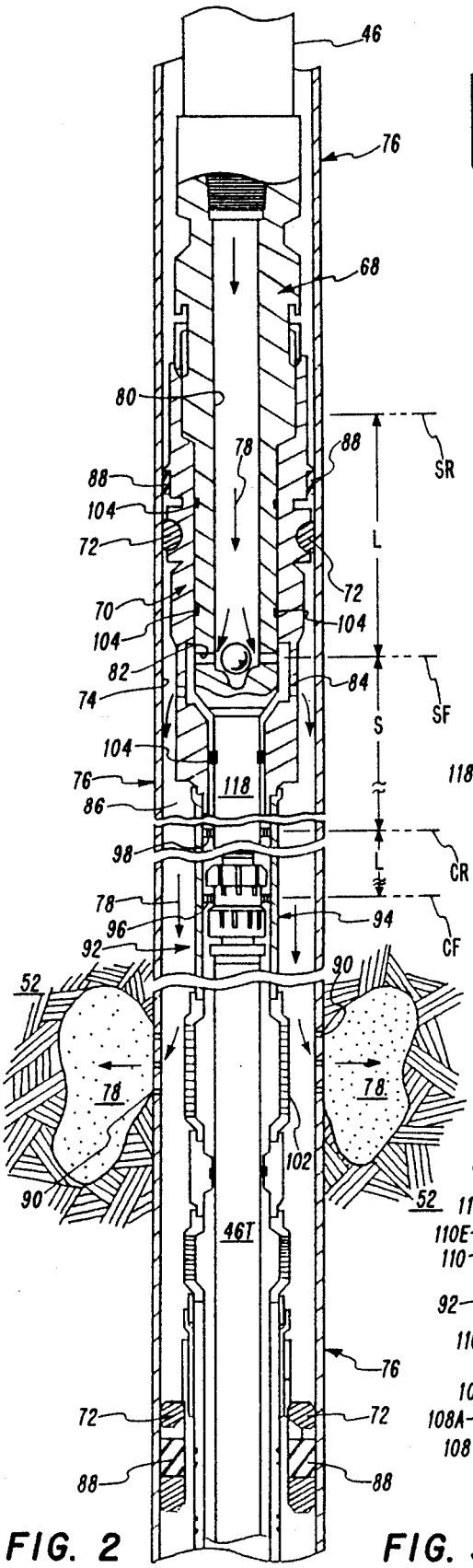
FIG. 2 is a view, partially in section and elevation, showing a typical well installation using the present invention below a production packer.
Figure 3:
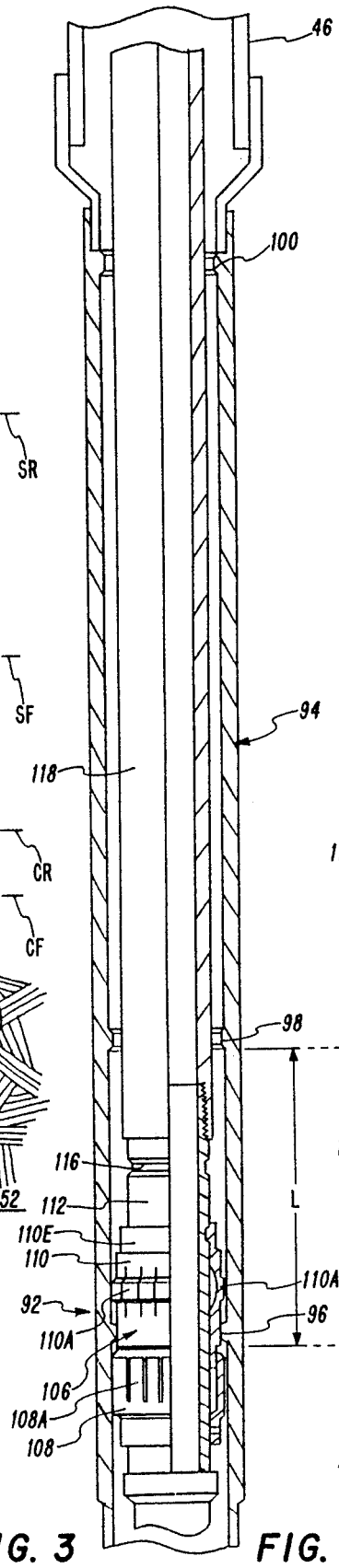
FIG. 3 is a view similar to FIG. 2, partially in section and elevation, showing the positioning apparatus of the invention as it is brought into engagement with an annular locator ring.

In FIG. 2, a typical gravel pack service operation is illustrated in which a cross-over tool (service seal unit) 68 is landed within a packer 70. The packer 70 has mechanically- or hydraulically-actuated slips 72 which set the packer against the inside diameter bore 74 of a tubular well casing 76. The service seal unit is coupled to the packer while a gravel slurry 78 is pumped through the work string 46 and bore 80 of the service tool 68 through lateral flow passages 82 which intersect the sidewall of the tool 68, and which communicate with lateral flow passages 84 which intersect the sidewall of the packer 70. The annulus 86 between the casing and the production conduit 94 is sealed above and below the producing formation 52 by expanded seal elements 88. The annulus 86 is filled with the slurry 78, and the slurry is pumped through perforations 90 formed in the sidewall of the well casing 76. It can be seen that close control of the position of the service tool 68 within the bore of the packer 70 is essential to carry out the slurry service operation.

Accurate positioning of the service tool 68 with respect to the packer 70 to accomodate various service operations is provided, in a first preferred embodiment of the invention, by a reciprocating positive indicator latch assembly 92 which is connected in series with the work string 46 at a point below the service tool 68 and packer 70. In this arrangement, a locator sub 94 carrying a plurality of annular locator shoulders 96, 98 and 100 is connected in series intermediate the lower end of the packer 70 and the screen 102. In this arrangement, the locator sub is a permanent addition to the production tubing and remains downhole. The annular locator rings are located at two stations designated CF and CR which correspond with service tool stations SF and SR, respectively. When the latch assembly 92 is engaged with the locator ring 96 at latch station CF, the lateral flow passages 82 of the service tool 70 are in communication with the lateral flow passages 84 of the packer 70 whereby the annulus 86 and the formation 52 can be charged with a service fluid such as gravel slurry 78.

After the well treatment procedure has been completed, the bore 80 of the service tool along with the work string is pressurized with clean-out fluid to remove excess slurry and to clean the work string bore. This is carried out with the sealing surfaces 104 carried by the service tool engaged within the polish bore of the packer 70, and with the lateral flow passages 82 of the tool 68 positioned generally at station SR to admit the flow of clean-out fluid. The clean-out fluid is circulated downwardly through the annulus intermediate the well casing and the work string, with the clean-out fluid moving in reverse flow direction upwardly through the bore 80 of the service tool and through the work string 46.

The locator rings 96, 98 are selectively engaged and released by a compound collet latch assembly 106 which is connected to the work string between the downhole service tool 68 and the tail pipe 46T. The compound collet assembly 106 carries a fixed annular collet 108 and a slidable annular collet 110. The fixed collet 108 is rigidly attached to a tubular collet sub 112 and includes a plurality of flexible fingers 108A. Annular index grooves 114, 116 are machined into the exterior sidewall of the collet sub 112. Traveling collet 110 is provided with a flexible finger portion 110A having a knuckle portion 110B received in detented engagement within index groove 114.

According to this arrangement, the position of the fixed collet 108 relative to the first operating position SF of the service tool 68 is pre-established by the length of the collet sub 112 and coupling sub 118 by which it is attached to the service tool 68. The resilient finger portions 108A and 110A deflect inwardly in response to engagement with the locator ring 96 as the work string 46 is lowered through the casing 76. The flexible finger portions of the fixed and movable collets deflect to allow passage of the compound collet assembly by each locator ring.

Figure 4:
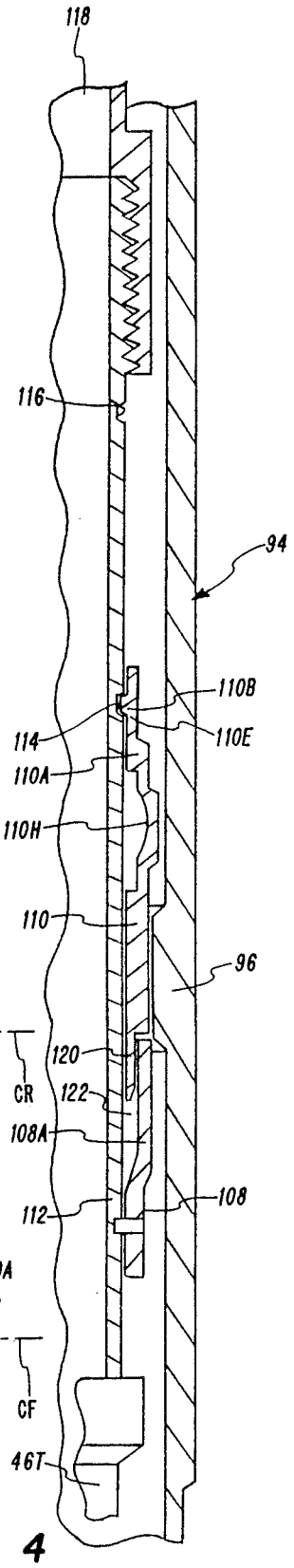
FIG. 4 is a fragmentary enlarged view showing the positive indicator collet assembly in latched engagement with a locator ring.
Figure 5:
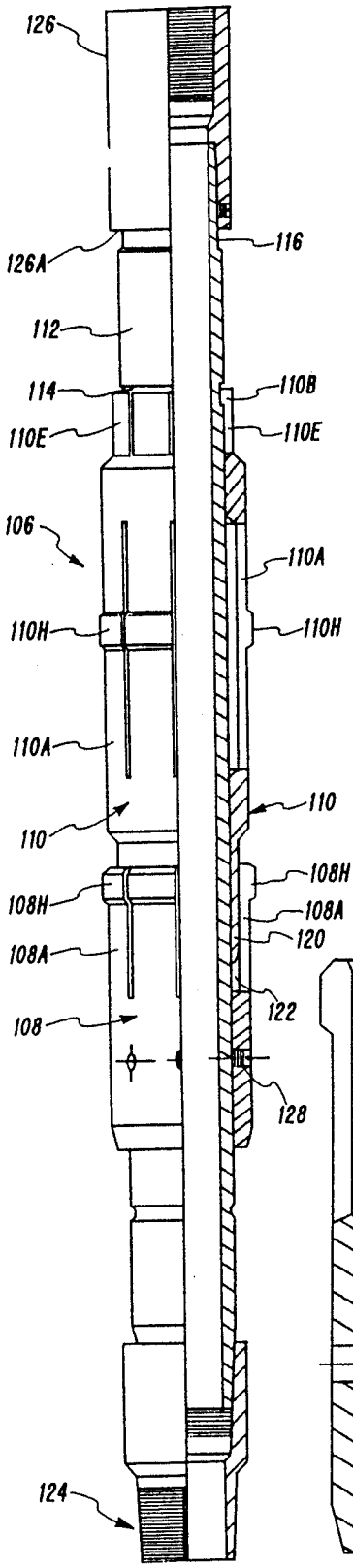
FIG. 5 is an elevational view, partly in section, of the positive indicator collet latch sub of FIG. 2.
Figure 6:
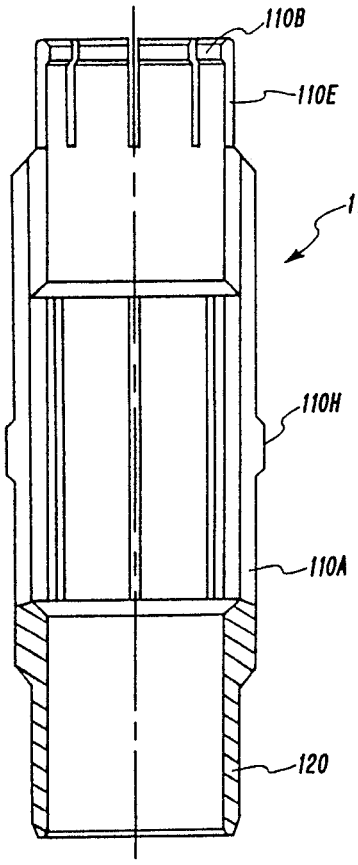
FIG. 6 is a sectionl view of the movable collet member shown in FIG. 5.
Figure 7:
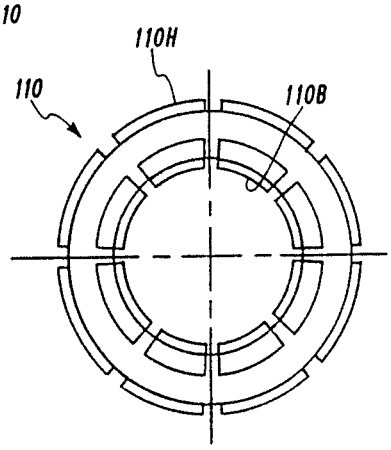
FIG. 7 is a top plan view of the movable collet assembly shown in FIG. 6.
Figure 8:
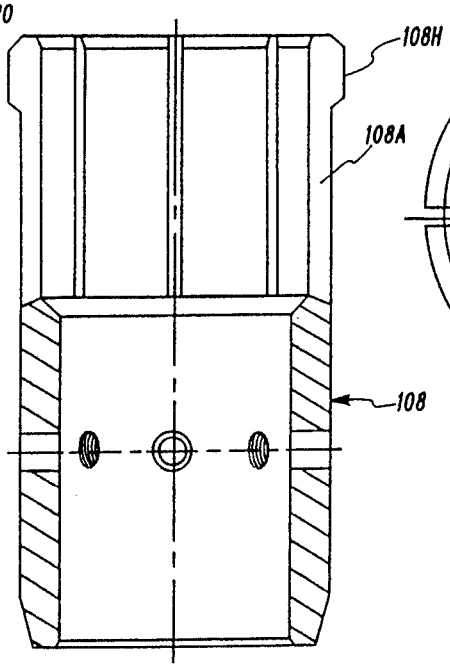
FIG. 8 is a sectional view of the fixed collet assembly shown in FIG. 5.
Figure 9:
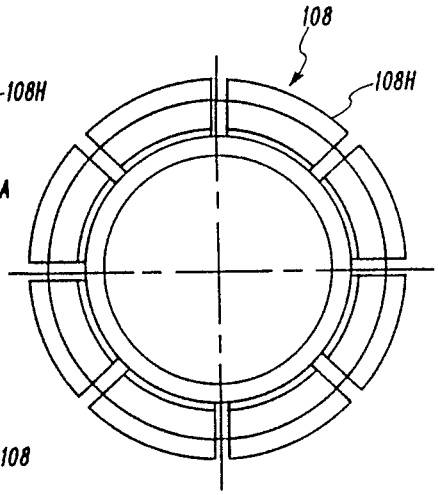
FIG. 9 is a top plan view of the fixed collet member shown in FIG. 8.

The movable collet 110 is provided with a radially stepped shoulder portion 120 which is received within an annular pocket 122 lying between the flexible finger portion 108A and the sidewall of the collet sub 112. In this position, the stepped shoulder portion 120 supports the end of flexible finger 108A against radial deflection, with the result that the end of the flexible finger portion 108A bears against the annular locator ring 96 and opposes further upward movement of the work string. That is, the presence of the stepped shoulder portion 120 in the intermediate location as depicted in FIG. 4 prevents radial deflection of the flexible finger portion 108A of the fixed collet as the work string is retracted. Because of the pre-established fixed spacing distance (S+L) of the service tool relative to the fixed collet, the sealing surfaces 104 and the flow passages 82 of the service tool are positioned exactly as desired for carrying out the gravel pack service operation.

When it is desired to reposition the service tool 68 with respect to the packer 70 to carry out a second service operation, for example a reverse flow clean-out procedure, the work string 46 is lowered through the casing 76 which draws the head portion 110A of the movable collet into engagement with the top side of the annular locator ring 96, thereby preventing its further displacement and allowing continued downward movement of the fixed collet 108 and work string 46. The work string slides relative to the movable collet 110 which is held by engagement of its head portion with the locator ring. Movement continues until the knuckle portion 110B of the movable collet engages the locator detent groove 116 and the top of the extended finger 110E engages the lower face of the box 126.

The amount of displacement during set-down and the amount of weight that is set down is monitored and gauged to avoid going past the desired locator ring. Upon detection of engagement, the work string is lifted upward again and the unsupported collet is moved past the locator ring. A sudden reduction in indicated set down weight signals the engagement and passage of the latch assembly through a locator ring as the work string is lowered. Likewise, a sudden increase in indicated tension loading signals latching engagement of the fixed collet against the locator ring.

As a result of this displacement operation, the movable collet 110 and the fixed collet 108 are completely separated so that the work string can then be retracted upwardly through the production tubing, with the resilient finger portions 108A of the fixed collet deflecting inwardly to allow passage of the fixed collet with respect to the first locator ring at station CF. As the work string is retracted upwardly through the production tubing, the head portion 110H of the movable collet is drawn into engagement with the second locator ring 98 at station CR. The movable collet 110 is held in place as the collet carrier sub 112 continues upward movement, pulling the fixed collet 108 over the stepped shoulder member 120, thereby supporting finger 108A against deflection, and driving the traveling collet head through the locator ring 98. Collet head portion 110H deflects allowing passage of the movable collet 110 relative to the second locator ring 98.

Further movement of the work string is halted as the stepped shoulder portion 120 of the movable collet is received within the pocket 122 and the finger 108A of the fixed collet is brought into engagement with the under side of the second annular locator ring 98. The displacement distance L traveled by the fixed collet corresponds exactly with the displacement distance of the service tool as its lateral flow passages 82 move into alignment with its second operational position SR.

It will be seen, therefore, that the locator rings 96 and 98 permit manipulation of the work string 46 such that when the fixed collet engages one of the locator rings, the operator at the well surface knows the exact position of the service tool relative to other down hole components and can carry out a service operation accordingly. Engagement and release are confirmed by work string tension and set down weight measurements which are monitored at the well surface. Additionally, engagement of the fixed collet against a locator ring provides a restriction to longitudinal movement of the work string which activates the motion-compensating system carried aboard the floating service vessel so that ocean heave or swell does not cause excessive longitudinal excursions of the service tool 68 and therefore will not interefere with an ongoing service operation.

Referring now to FIGS. 5, 6, 7, 8 and 9, the fixed and movable collets 108, 110, respectively, are assembled onto the collet sub 112 which is provided with a threaded pin connector 124 and a threaded box connector 126. The fixed collet 108 is securely fastened to the tubular collet sub by lugs 128. The knuckle portions 110B are carried by flexible finger extension portions 110E. Preferably, because of the resilience of the flexible finger portions, the knuckle portions 110B snap out of detented engagement in response to engagement of the head portion 110H against the annular locator ring as the work string is lowered or raised. However, the gripping force exerted by the knuckle portions in detented engagement in the annular locator groove 116 is strong enough to maintain the separated position of the traveling collet 110 with respect to the fixed collet 108 after separation has been obtained. It is important to maintain the separation of the traveling collet with respect to fixed collet as the work string is lowered into the production tubing and as the collets negotiate the locator rings in turn.

Shifting of a supporting surface relative to a flexible collet head is provided in an alternative embodiment of the invention as illustrated in FIGS. 10, 11, 12, 13, 14A, 14B and 14C. In this assembly, a reciprocating, positive indicator latch assembly 130 provides restriction to longitudinal movement of the work string and selected positioning of the service tool 68 by a tubular positioning sub 132 having a collet 134 mounted for longitudinal reciprocal movement relative to the sub. A radial shoulder 136 formed in the sidewall of the collet sub 132 blocks deflection of the collet finger 134A when a head portion 134H of the flexible finger is engaged with the shoulder 136.

Figure 14A:
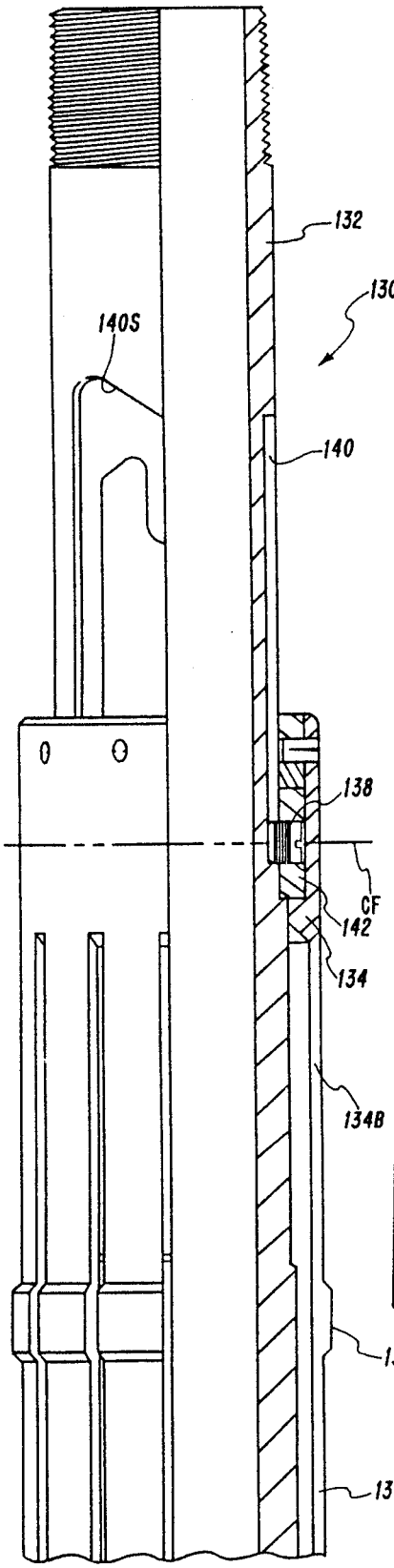
FIGS. 14A, 14B and 14C are elevational views, partly in section, of the positive indicator latch assembly shown in FIG. 10 with the movable collet engaged in a restrictive coupling engagement with a locator ring carried by the production tubing.
Figure 14B:
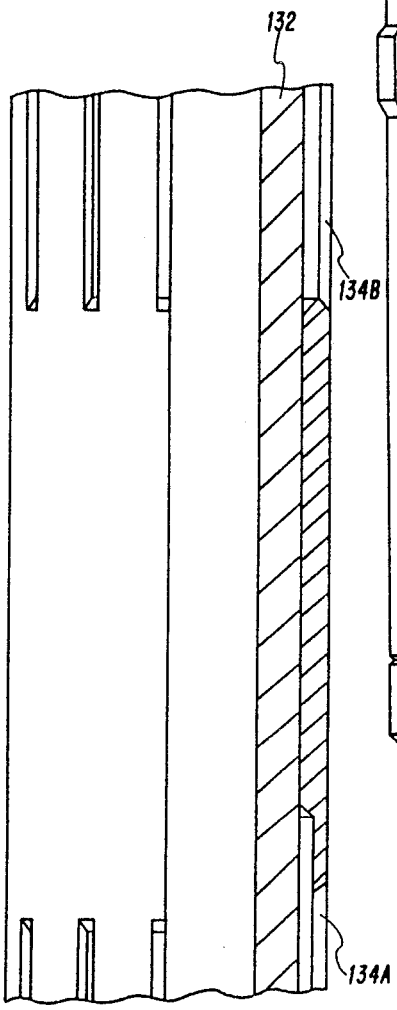
Figure 14C:
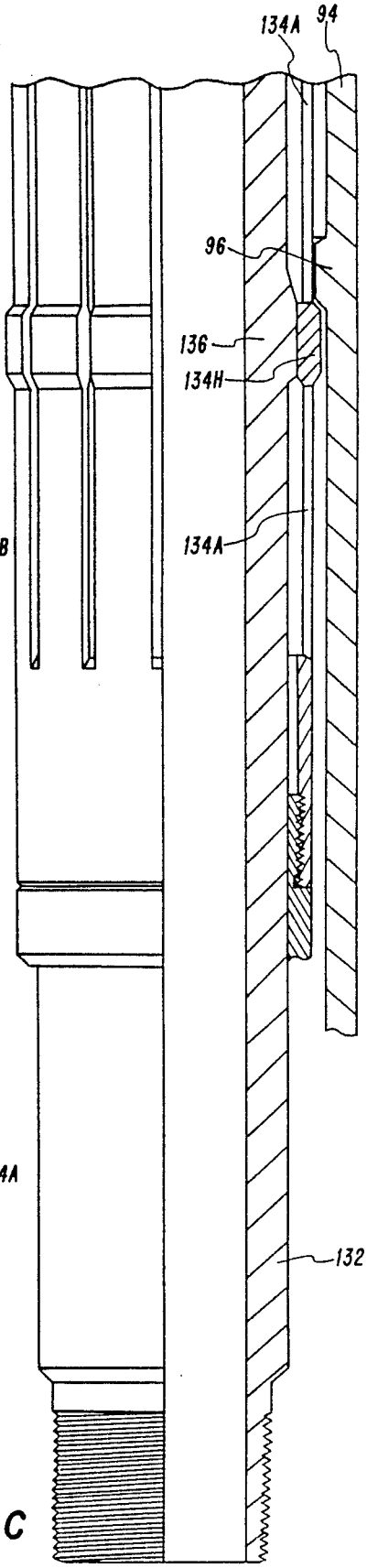

Engagement of the supported collet head 134H against the under side of the annular locator ring 96, as shown in FIG. 14C, accurately locates the working position of the service tool 68 at station SF as illustrated in FIG. 2. Repositioning of the collet head 134H to bear against the under side of the second annular locator ring 98, which corresponds with locator position CR and service tool position SR as shown in FIG. 2, is accomplished by lowering the work string downwardly through the production tubing until the upper collet head 134K engages the top side of locator ring 96. This engagement arrests further downward displacement of the collet 134 while the work string and positioning sub continue downward movement for a predetermined distance. Longitudinal displacement of the work string relative to the traveling collet 134 is limited by movement of a pin within a J slot 140 machined into the external sidewall surface of the positioning sub 132.

The pin 138 is constrained to travel along the vertical and slanted surfaces of the J slot 140. The traveling collet 134 is movably coupled to the positioning sub 132 by an annular bearing collar 142. The annular bearing collar is coupled in sliding engagement about the external cylindrical surface of the tubular positioning sub 132 with pins 138 projecting radially into the J slot groove on opposite sides of the positioning sub. The annular bearing collar 142 rotates in response to movement of the pins 138 along slanted slot surfaces 140S. That is, both vertical displacement of the positioning sub and rotation of the annular bearing collar 142 take place simultaneously as the pins bear against a slanted J slot surface 140S.

Figure 10:
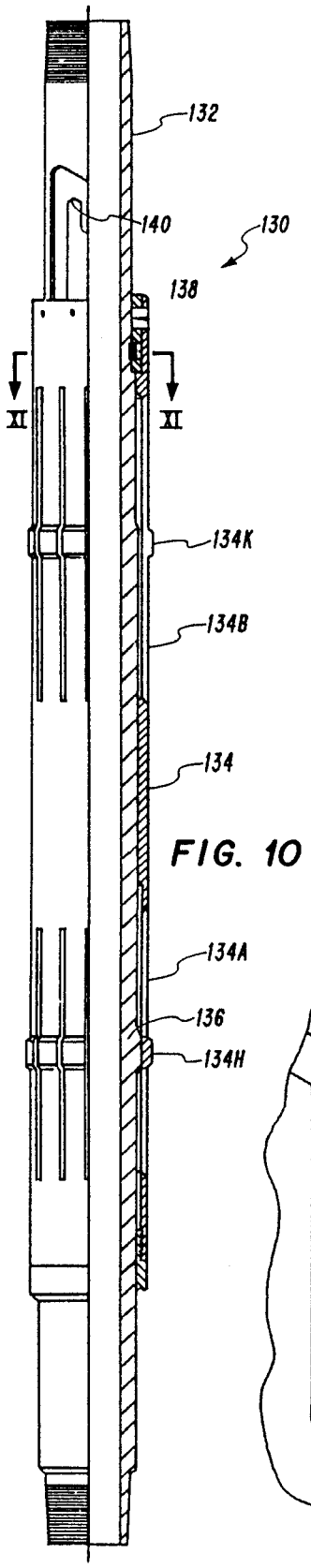
FIG. 10 is an elevational view, partly in section, of a reciprocating positive indicator latch assembly according to an alternative embodiment of the invention.
Figure 11:
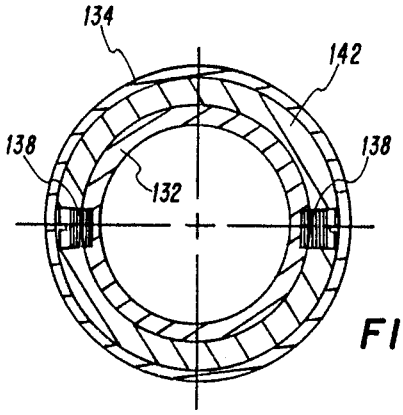
FIG. 11 is a sectional view, taken along the lines of XI—XI of FIG. 10.
Figure 12:
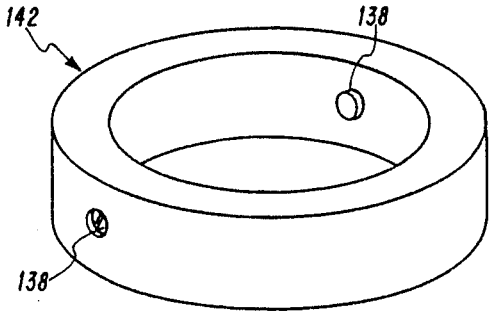
FIG. 12 is a perspective view of a collar-bearing member which carries pin members which ride within a J slot formed within the tubular sidewall of the collet sub shown in FIG. 10.
Figure 13:
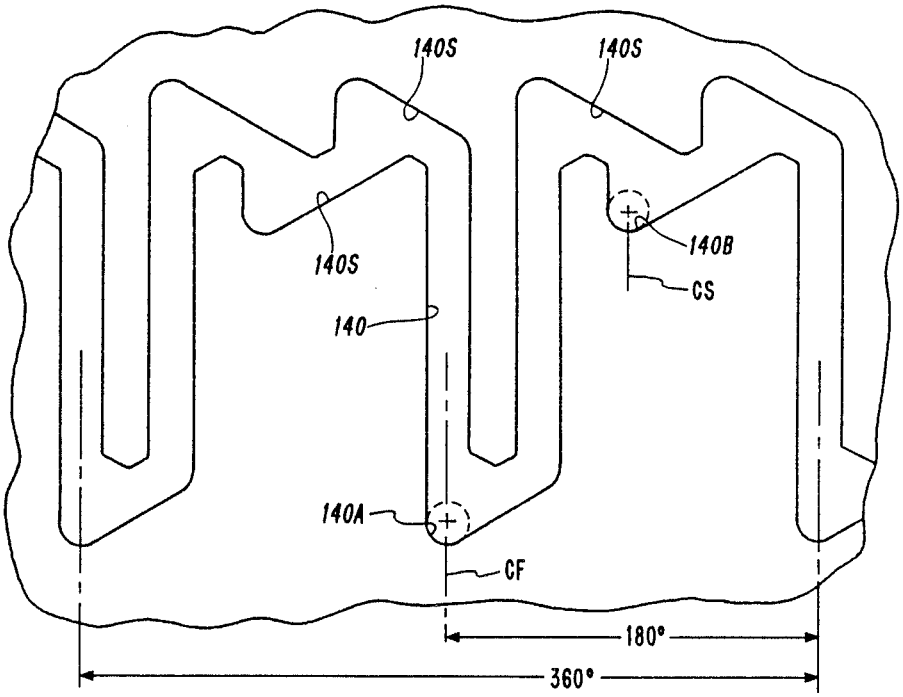
FIG. 13 is a developed plan view of the J slot shown in FIG. 10.

By a sequence of reciprocal longitudinal displacements of the work string 46, the pins 138 are repositioned within the J slot from a position designated as CF to the position designated as CS in FIG. 13. Position CF corresponds with the position of the collet 134 in its supported position as shown in FIG. 10, and position CS corresponds with the unsupported collet location with collet head 134H being longitudinally displaced with respect to radial shoulder 136. In the supported position, the flexible finger 134A of the collet is free to deflect and thereby pass a locator ring without binding engagement. That is, the collet head 134H is free to deflect to permit passage of the traveling collet relative to the locator ring as the work string is retracted to position the service tool to the new operating position SR.

The traveling collet 134 is provided with lower and upper sets of flexible finger members, 134A, 134B, respectively. Collet head portions 134H, 134K are disposed at intermediate locations on the respective finger portions.

Initially, the positioning sub 132 is run into the well attached to the service seal unit which is installed in the packer assembly in the lowest operating position (squeeze position) with the collet head 134H in a supported location. As the work string is retracted, collet head 134K engages the locator ring 96. Continued upward movement of the work string pulls collet head 134K through locator ring 96 and permits collet head 134H to engage locator ring 96 and stop upward movement. The desired service operation is then carried out with the service tool being held at the desired operating location.

After that particular service operation has been completed, it may be desired to move further up the well. In that instance, the tubing string is set down to engage collet head 134K against the upper side of locator ring 96, with the result that the traveling collet 134 is displaced upwardly relative to the positioning sub to the uppermost station CS. Upon detection of engagement, the work string is lifted upward again and the unsupported collet is moved past the locator ring.

The foregoing procedure is repeated as many times as necessary to engage or bypass each locator ring in turn. Any desired number of locator rings can be installed within the production conduit sub before it is run into the well bore. Both embodiments of the collet latching assembly can be run through all locator rings and can be set to locate the service tool at different operating positions. After a particular service operation has been completed, the tension force applied to the work string is slacked off allowing the work string to be reciprocated to manipulate the movable collet latch. The collet latch assembly is then pulled up through the locator ring to engage a locator ring at the next pre-established locator station. The motion compensator carried aboard the service vessel will hold the tool located and relatively motionless while the service operation is performed at the desired location. Engagement of the fixed collet against the locator ring while maintaining tension on the work string above its pick-up weight insures that the desired location of the service tool will be maintained.

It will be appreciated that each of the foregoing embodiments provide a selective, positive restriction to longitudinal movement which allows accurate positioning of a downhole service tool at a preselected location. Moreover, both embodiments provide a partial restriction to longitudinal movement of the work string which will activate the motion-compensating system of a floating service vessel so that ocean heave or swell does not cause undesired longitudinal movement of a downhole service tool, which might interfere with an ongoing service operation.

Although the invention has been described with reference to specific embodiments, and with reference to a specific off-shore service operation, the foregoing description is not intended to be construed in a limiting sense. Various modifications to the disclosed embodiments as well as alternative applications of the invention will be suggested to persons skilled in the art by the foregoing specification and illustrations. For example, the collet latch assembly may be used in other types of well completions wherein it would be desirable to start the work string at an upper location and move down the well using the coupling engagement of the collet assembly and locator rings to stop the work string at each locator station as the service tool is moved downhole. Moreover, both collet latch assemblies can be used to good advantage in combination with fixed production facilities for accurately positioning a service tool relative to down hole completion equipment. It is therefore contemplated that the appended claims will cover any such modifications, applications or embodiments as fall within the true scope of the invention.

What is claimed is:

1. A method for restricting longitudinal movement of a service tool suspended by a work string within a production tubing comprising the steps:

obstructing the annulus between the production tubing and the work string with an annular locator ring mounted on said production tubing string;

longitudinally reciprocating a latch assembly having a fixed collet attached to said work string and a movable collet slidably mounted on said work string;

engaging the annular locator ring with the movable collet and moving said movable collet longitudinally to a separated position on said work string relative to the fixed collet lowering said latch assembly below said locator ring;

retracting the work string and inserting the movable collet into a pocket formed between the work string and fixed collet for preventing deflection of said fixed collet; and, engaging the locator ring with the fixed collet while the movable collet is inserted within said pocket.

2. A method as described in claim 1, including the steps of stabilizing the positions of the movable collet in the separated position and the inserted position by engaging first and second detent locator grooves formed in said work string coincident with the separated position and the inserted position of the movable collet, respectively, with a knuckle member formed on a resilient finger of said movable collet.

3. A method for restricting longitudinal movement of a service tool as defined in claim 1, wherein the restrictive engagement between the fixed collet and the annular locator ring is released by lowering the work string to draw a head portion of the movable collet into engagement with the top side of the locator ring until the movable collet is displaced to its separated position and the fixed collet is free to deflect radially inwardly; and, retracting the work string to draw the fixed collet into engagement with the under side of the locator ring with a force great enough to cause the fixed collet to deflect radially inwardly, thereby allowing passage of the fixed collet past the locator ring.

4. A collet latch assembly for selectively engaging a locator ring within the bore of a production conduit for positioning a service tool with respect to a downhole completion apparatus comprising:

a tubular conduit adapted for attachment to said service tool, said tubular conduit having first and second annular locator grooves spaced apart along the external surface of said conduit;

a fixed collet secured to said conduit, said fixed conduit having flexible fingers spaced apart from the tubular conduit thereby defining an annular pocket therebetween, said resilient fingers being adapted to deflect inwardly into said annular pocket in response to a radially-directed force;

a floating collet mounted about said tubular conduit for reciprocal longitudinal movement with respect thereto, said floating collet having a plurality of resilient finger portions, each finger portion carrying a radially-projecting head portion, and having resilient finger extension portions, each resilient finger extension portion having a knuckle portion adapted to be received in detented engagement within the first annular locator groove and the second annular locator groove, and said floating collet having a radially-offset shoulder portion adapted to be inserted within the annular pocket defined by the flexible fingers of said collet; and, said floating collet being adapted to be moved from a supporting position in which the knuckle portions of its finger extensions are received in detented engagement with the first annular locator groove, and its radially-offset shoulder portion is received within said annular pocket, with said offset shoulder portion lying intermediate the conduit sidewall and the flexible fingers of said fixed collet, thereby opposing radial deflection thereof, and movable to a separated position in which the knuckle portions of said floating collet are received in detented engagement within the second annular locator groove, wherein the offset shoulder portion of said floating collet is withdrawn from the annular pocket, thereby permitting the resilient fingers of said fixed collet to deflect radially inwardly.

* * * * *